US005105231A

United States Patent [19]

Watanabe et al.

[11] Patent Number: 5,105,231

[45] Date of Patent: Apr. 14, 1992

[54] IMAGE FORMATION APPARATUS HAVING MEANS FOR REVERSING THE ORDER OF STACKING OF IMAGE BEARING DOCUMENTS

[75] Inventors: Junji Watanabe, Yokohama; Yuji Ishikawa, Machida, both of Japan

[73] Assignee: Kabushiki Kaisha Toshiba, Kawasaki, Japan

[21] Appl. No.: 297,312

[22] Filed: Jan. 17, 1989

[30] Foreign Application Priority Data

Jan. 21, 1988 [JP] Japan ..... 63-9582
Jan. 21, 1988 [JP] Japan ..... 63-9583

[51] Int. Cl.[5] ..... G03G 21/00; B65H 39/10

[52] U.S. Cl. ..... 355/323; 271/291; 271/296

[58] Field of Search ..... 355/318, 319, 321, 323; 271/291, 296

[56] References Cited

U.S. PATENT DOCUMENTS

| | | | |
|---|---|---|---|
| 4,202,621 | 5/1980 | Yoshimura et al. | 355/311 |
| 4,209,249 | 6/1980 | Clark et al. | 355/319 |
| 4,322,069 | 3/1982 | Mitchell | 355/323 X |
| 4,449,813 | 5/1984 | Kikuchi et al. | 355/206 |
| 4,515,458 | 5/1985 | Masuda et al. | 355/313 |
| 4,618,245 | 10/1986 | Fukushi et al. | 355/323 X |
| 4,806,979 | 2/1989 | Tokoro et al. | 355/319 |

*Primary Examiner*—Fred L. Braun
*Attorney, Agent, or Firm*—Foley & Lardner

[57] ABSTRACT

An image formation apparatus having an original feeding plate for retaining a supply of originals, a take-out roller for taking out the originals sheet by sheet, a copying device for forming on sheets an image corresponding to the image information of the original taken out by the take-out roller, a plurality of bins for receiving the sheets having images formed by the copying device, a reversing unit which can selectively reverse the stacking order of the image receiving sheets, and a guide unit which distributes to bins the sheet whose direction of the surface has been converted by the reversing unit.

12 Claims, 14 Drawing Sheets

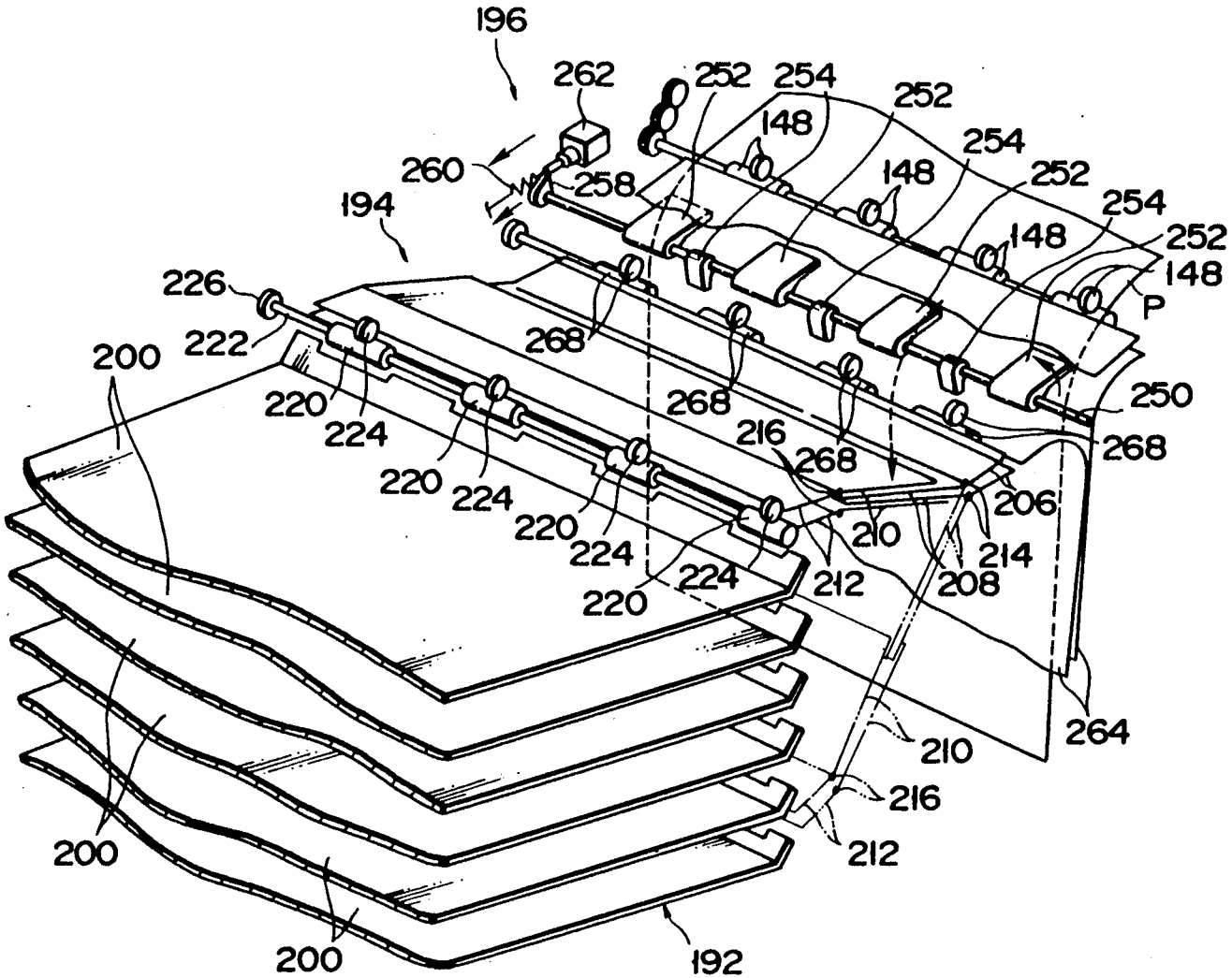
196
194
192
200
200
200
226
222
220
224
220
224
220
224

IMAGE FORMATION APPARATUS HAVING MEANS FOR REVERSING THE ORDER OF STACKING OF IMAGE BEARING DOCUMENTS

BACKGROUND OF THE INVENTION

1. Field of the Invention

This invention relates to an image formation apparatus, such as, an electronic copying machine, provided with a selective sheet sorting function.

2. Description of the Related Art

Electronic copying machines of known construction include those comprising a copying device, an automatic original feeder and a sorting device.

The copying device of such a machine comprises an original placement plate for carrying an original to be copied, an image formation unit for forming an image corresponding to the image information of the original on sheet material, and discharge rollers for discharging the imaged sheet material externally of the device.

The automatic original feeder is generally provided with an original feeder plate on which originals to be copied are supplied, an original delivery and discharge unit which deliver the originals from the original feeder plate to the original placement plate and discharges them out of the original placement plate, and an original discharge bins or trays for receiving the originals discharged by the delivery and discharge unit.

The sorter device includes a vertically movable support frame, a plurality of bins or trays positioned vertically along with support frame, and a pair of feed rollers which transport sheet material discharged by the copying device via a pair of discharge rollers to a selected one of bins. A sorter device of this type is disclosed in U.S. Pat. No. 4,618,245.

In the sorter device of the above known arrangement, all bins conjointly perform upward and downward movements. During the course of the movements, each bin faces feed rollers in turn, whereby imaged sheet material is sorted in each bin. This requires all of the sheets carried by different bins to be moved upward or downward in line with the movement of bins, with the result that a large actuation power is necessary for the movement of the bins.

In automatic original feeder devices of a known construction, an original to be copied is fed to the original feeder plate with its image carrying surface facing downward. The original is sent to the original placement plate and discharged to the original receiving bins with its image carrying surface retained to face downward. An original subsequently fed is treated in the same manner and placed on the preceding one after a copying cycle. With the copying device, on the other hand, an image is formed on the upper surface of sheet material and the sheet is discharged with its imaged surface facing upward. In the sorting device, the sheet material is received by a bin with its imaged surface facing upward. Subsequently fed sheets of paper are received by the bins and placed on preceding ones in a like fashion. The above arrangements cause the order of pages of accumulated originals and that of the sheet material to be reversed. This provides inconveniences in handling in that an additional work is required for re-ordering the pages of the sheet material.

Further, the number of sortings available to the sheet material depends on the number of bins available. Increasing the number of sortings, therefore, requires an increased number of bins, thus disadvantageously increasing the size of the device.

SUMMARY OF THE INVENTION

An object of the invention is to provide an image formation apparatus capable of selectively sorting sheet material with small actuation power and which permits the sheet material to be discharged in the same order of pages as the originals and which further provides an increasing number of sortings without inviting the problem of increasing the size of the device.

According to an aspect of the present invention, there is provided an image formation apparatus comprising retaining means for retaining a plurality of originals including image information, take-out means for taking out the originals one by one, image forming means for forming on sheets an image corresponding to the image information of an original taken out by said take-out means, a plurality of reception sections for receiving the sheets, and distributing means for distributing the sheet material to the reception sections, said distributing means including direction-converting means for selectively converting directions of the sheets.

BRIEF DESCRIPTION OF THE DRAWINGS

FIGS. 8A to 8C are perspective views of the mechanism shown in FIG. 4 to explain its reversing operation;

DETAILED DESCRIPTION OF THE PREFERRED EMBODIMENTS

One embodiment of the invention will be described with reference to FIGS. 1 to 10.

Figure 1:
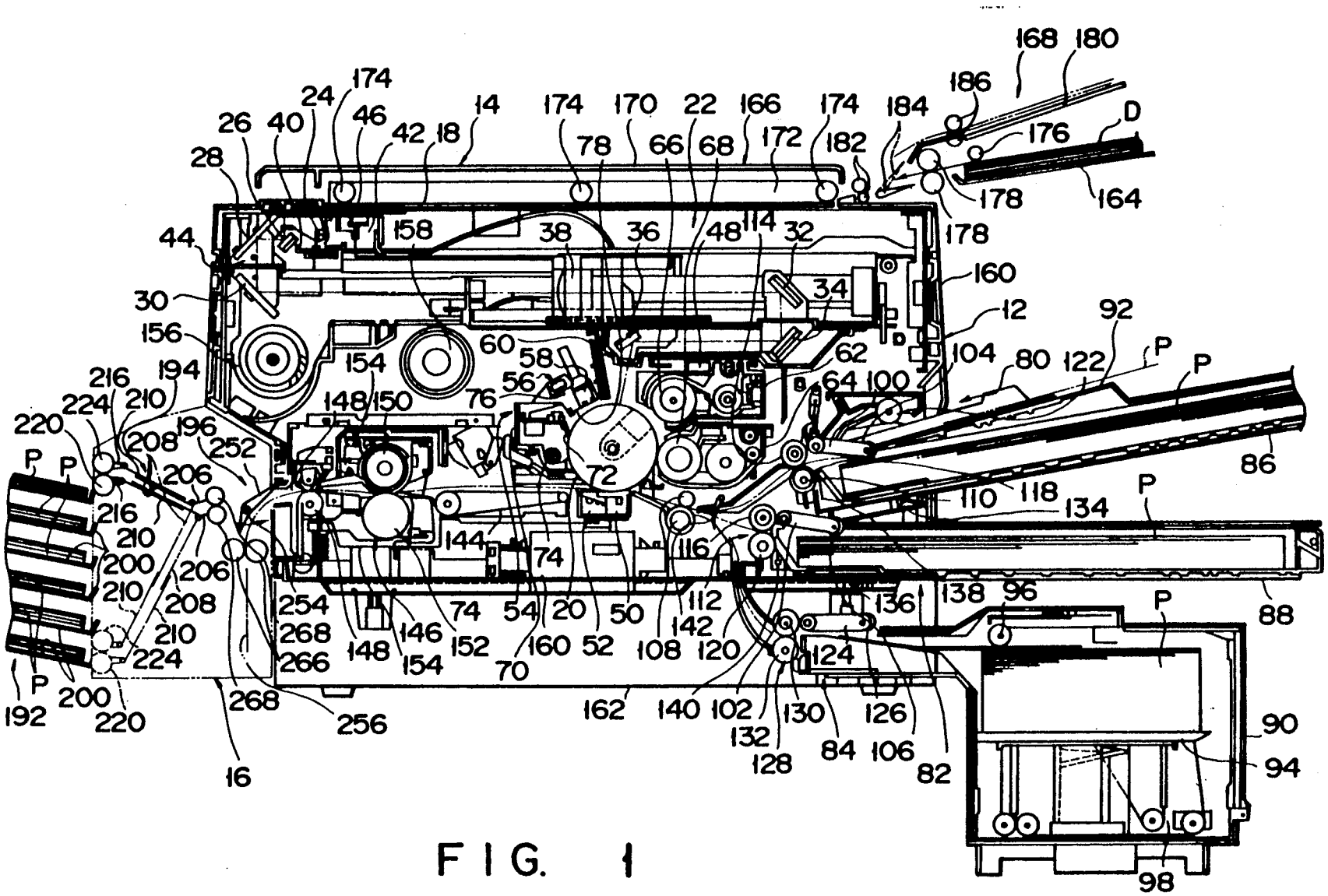
FIG. 1 is a cross section of an electronic copying machine representative of the image formation apparatus according to this invention.

FIG. 1 shows an electronic copying machine representative of the image formation apparatus according to this invention. The copying machine is illustrated to comprise copying device 12, automatic original feeder 14 and a sorter 16.

Secured on copying device 12 is original document plate 18 of transparent glass for placing an original D to be copied. A photosensitive drum 20 is journaled for rotation within copying device 12 substantially at a center thereof.

Between photosensitive drum 20 and original plate 18 are interposed exposure device 22 which includes lamp 24, 1st to 6th mirrors depicted by the reference numerals 26, 28, 30, 32, 34 and 36, and lens 38. Lamp 24 is surrounded at its rear portion by reflector 40. A light emitted by lamp 24 is projected by reflector 40 to a surface of the original D placed on original plate 18. The original D placed on original plate 18 is scanned in incremental lines while being irradiated by lamp 24. The light reflected by the original D is focused on the photosensitive surface of drum 20 to form an image thereon, past 1st to 3rd mirrors 26, 28, 30, lens 38, 4th to 6th mirrors 32, 34, 36 in the order mentioned. Lamp 24 and 1st mirror 26 are mounted on first carriage 42, and second and third mirrors 28, 30 on second carriage 44. During scanning of the original D, first and second carriages 42, 44 perform a reciprocating motion in synchronism with the rotation of photosensitive drum 20. Further, in order to make constant the length of an optical path between original D and photosensitive drum 20, second carriage reciprocates in the same direction as first carriage 42 at a speed one half that of first carriage 42. On first carriage 42 is mounted designation unit 46 which designates areas by way of a spot light where it is desired to copy original D with the exclusion of such areas.

Subsequent to the position of an image focused by exposure device 22 in the direction of photosensitive drum rotation and about photosensitive drum 20 are developer device 48, transfer device 50, separation device 52, cleaner device 54, discharging device 56, charging device 58 and erasing device 60 in the order mentioned.

Corona discharge devices are used respectively as charging device 58, transfer device 50 and separation device 52.

Erasing device 60 comprises a plurality of LEDs arranged in the axial direction of photosensitive drum 20. The LEDs are selectively irradiated in response to designations by designation unit 46, whereby the surface potentials of photosensitive drum 20 that correspond to the areas designated by designation unit 46 are removed.

Development device 48 includes upper developer unit 62 for color development and lower developer unit 64 for black and white development. These units 62, 64 include development rollers 66, 68 to effect development using a magnetic brush development process. Development rollers 66, 68 selectively approach photosensitive drum 20 whereby black toner or toner in another color, such as red, may be selectively loaded on drum surface 20.

Cleaner 54 comprises a casing 70, cleaning blade 72 for scraping off residual toner from drum surface 20, auger 74 for transporting the amount of toner removed by cleaning blade 72 externally of casing 70, and a collection box, not shown, for receiving the toner particles transported by auger 74.

Discharging device 56 comprises discharging lamp 76 for subjecting photosensitive drum 20 to optical exposure at uniform surface potential, and green filter 78 disposed in a path of light impinged upon drum surface 20 by discharging lamp 76.

Disposed within copying device 12 at a bottom right-hand portion are, in the order of top to bottom, first, second and third mounting sections 80, 82, 84. First mounting section 80 removably receives upper sheet feeding cassette 86 for storing a supply of sheets of paper p. Second mounting section 82 is detachably loaded by lower sheet feeding cassette 88 for storing a supply of copy sheets p. Third mounting section 84 detachably receives sheet feeding device 90 which is larger in size to store a large supply of copy sheets p.

A manual feeding guide 92 is secured on the upper surface of upper feeding cassette 86 for manually feeding sheet material p. Guide 92 also serves to be a cover for upper feeding cassette 86.

Large capacity sheet feeding device 90 is provided with sheet feeding plate 94 on which a large supply of sheets p is stored in accumulation, transport roller 96 for sending out a first top sheet p of the accumulated supply of sheets p to a predetermined position, a detector, not shown, for detecting the position of the top sheet p, and elevating means 98 to constantly set the top sheet p in a position ready for delivery by transport roller 96, on the basis of a detecting signal from detector which detects completion of delivery of a fixed amount of sheets p from sheet feeding plate 94.

First and second mounting sections 80, 82 include, respectively, rockable arms 100, 102, take-out rollers 104, 106 secured on rockable arms 100, 102 and which take out sheets p from feeding cassettes 86, 88 in an orderly manner, and separation/transport means 110, 112 which separate sheets taken out by take-out rollers 104, 106 sheet by sheet and advance them to aligning roller 108 to be described later. Separation/transport means 110, 112 comprise transport rollers 114, 116 and separation rollers 118, 120 rotatably engaging transport rollers 114, 116.

Adjacent first mounting section 80 is advance roller 122 which advances a sheet p manually fed at manual feeding guide 92 to aligning roller 108 via transport roller 114 and separation roller 118. It is to be noted that when sheet p advances by the action of advance roller 122, transport roller 114 and separation roller 118 are parted.

Third mounting section 84 includes rockable arm 124, take-out roller 126 secured on arm 124 and which takes out sheets p advanced by transport roller 96 provided adjacent large capacity sheet feeder 90 in an orderly manner, and separation/transport means 128 which separates sheets taken out by take-out roller 126 sheet by sheet and advances them to aligning roller 108. Separation/transport means 128 comprises transport roller 130 and separation roller 132 rotatably engaging transport roller 130.

At first and second mounting sections 80, 82 are disposed, respectively, detection switches 134, 136 to detect the absence of sheets p in cassettes 86, 88, and detection switches 138, 140 to detect whether or not cassettes 86, 88 are loaded in position and also to detect the sizes of sheets in cassettes 86, 88. Third mounting section 84 comprises a detection switch (not shown) to detect if the loading of large capacity sheet feeder 90, which in turn includes a detection switch (not shown) to detect the absence of sheet supply. Large capacity sheet feeder 90 is connected via signal cables, not shown, to control units, not shown, which are housed in copying device 12, to attain exchange of various signals, so that signals from the detection switches are transmitted to the control units via the signal cables.

Between first to third mounting sections 80, 82, 84 and transfer device 12 is interposed aligning roller 108 which aligns a sheet p sent from upper and lower feeding cassettes 86, 88, manual feeding guide 92 and also from large capacity sheet feeder 90 and advances it to photosensitive drum 20 in a fixed timed relation.

Between aligning roller 108 and first to third mounting sections 80, 82, 84 is interposed switch 142 which detects the presence of a sheet destined for aligning roller 108.

Within the housing of copying device 12 are disposed, at its bottom portion, conveyor belt 144 for carrying the sheet p separated from photosensitive drum 20 by separation device 52, fixing device 146 for fixing a toner image on the sheet p delivered by conveyor belt 144, and a pair of discharge rollers 148 for discharging the toner image fixed sheet p externally of copying device 12. Fixing device 146 comprises heating roller 150 carrying a heater lamp therein, press roller 152 urged into press contact with heating roller 150, and a pair of casings 154, i.e., upper and lower ones, to enclose these rollers 150, 152. A detection switch (not shown) is mounted in the vicinity of discharge roller 148 to detect discharge of sheets p. Discharge roller 148 and this detection switch are assembled in fixing device 146. Discharging brushes, not shown, are provided in the vicinity of discharge roller 148 at its downstream side to discharge the sheet.

Within copying device 12 are cooling fan 156 and main motor 158 at positions above fixing device 146. A high voltage transformer 160 is mounted beneath conveyor belt 144. In addition, copying device 12 includes separable first and second units 160, 162, first unit 160 being placed upon second unit 162.

Subsequent to setting of an original D on sheet feeding plate 164 of automatic original feeder device 14, key operation at a control panel, not shown, causes automatic original feeding device 14 to set the original D on original plate 18.

Photosensitive drum 20 is rotated in a fixed direction. The surface of drum 20 is uniformly charged by charging device 58. The surface potential of drum 20 so charged is then eliminated in correspondence with the areas designated by designation unit 46. Thereafter, drum surface 20 is subject to exposure by exposure device 22, whereby an electrostatic latent image corresponding to the image information of original D is formed on drum surface 20. Toner is applied to the electrostatic latent image by developing device 48, whereby a black toner image or a toner image in another color, such as red, may be formed. Synchronously with the formation of the toner image, sheet p delivered from manual sheet feeding guide 92, upper cassette 86, lower cassette 88, or large capacity sheet feeder 90 via aligning roller 108 is electrostatically attached onto drum surface 20.

The toner image is transferred onto sheet p by the action of transfer device 50. Sheet p is then separated from drum surface 20 by separation device 52 and sent to fixing device 146 by conveyor belt 144. Fixing device 146 permits the toner image to be fixed on sheet p. Thereafter, sheet p is fed out of copying device 12 by discharge roller 148 and delivered to sorter 16.

The residual toner retained on photosensitive drum surface 20 without being transferred onto sheet p is removed by cleaning device 54. After cleaning, the surface potential of photosensitive drum 20 is discharged below a fixed level by discharging device 56, so that the machine is ready to perform the next cycle of copying operation.

Automatic original feeder 14 comprises first and second feed/discharge units 166, 168. First feed/discharge unit 166 is movably secured on the upper surface of copying device 12 at a rear side thereof. When original D is to be copied using automatic feeding function, first feed/discharge unit 166 is held down. But when the original material is thick, such as a book, it is retracted from the surface area of original plate 18. First feed/discharge unit 166 has platen cover 170 with a concave inner surface, original pressing sheeting 172 disposed along the concave inner surface of platen cover 170 and whose surface facing original plate 18 is white, and a plurality of advance rollers 174 which are disposed within original pressing sheet 172 and rotatable both in forward and backward directions.

Second unit 168 comprises original feeding plate 164 for placing originals D in accumulation, take-out roller 176 for taking out, in order, an original D placed atop originals D accumulated on original feeding plate 164, a pair of separation rollers 178 for separating originals taken out by take-out roller 176 sheet by sheet, original discharge plate 180 mounted above original feeding plate 164, a pair of delivery rollers 182 which supply original D separated by separation rollers 178 to first feed/discharge unit 166 and also deliver original D discharged by first feed/discharge unit 166 toward original discharge plate 180, rotatable gate 184 which guides original D from separation roller 178 to delivery rollers 182 and further guides original D from delivery rollers 182 to original discharge plate 180, and a pair of discharge rollers 186 for discharging original D guided by gate 184 onto original discharge plate 180 in an accumulated fashion.

Originals D are placed on feeding plate 164 in piles and in such a manner that surfaces bearing an image to be copied face downward. Originals D so placed are taken out by take-out roller 176 in order from the top. The original D is then supplied to first feed/discharge unit 166 via gate 184 and delivery rollers 182 and set in position on original plate 18 by a delivery roller 174. After being subject to a light exposure step, the original D is discharged out of first feed/discharge unit 166 by means of delivery roller 174. Thereafter, it is accumulated on discharge plate 180 so that its image carrying surface faces downward, after passing sequentially through delivery rollers 182, gate 184 and discharge roller 186.

Figure 6:
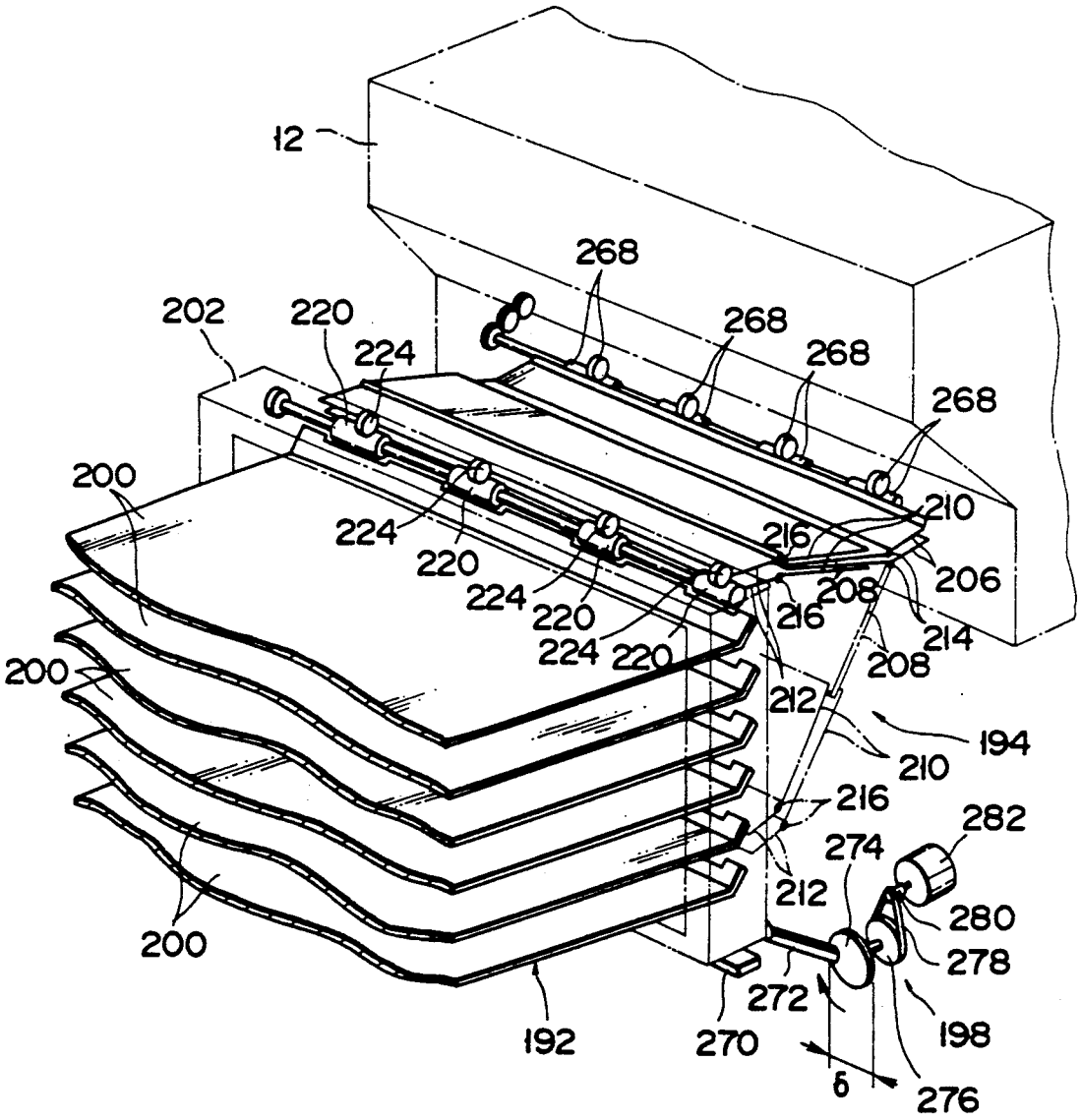
FIG. 6 shows a perspective view of a sideward movement unit employed in the sorter device used in the electronic copying machine shown in FIG. 1.

Sorter 16 is connected to copying device 12 at its side close to discharge roller 148 and comprises bin unit 192, guide unit 194, sheet reversing unit 196 and sideward movement unit 198 (see FIG. 6).

Bin unit 192 has a plurality of bins or trays 200 for receiving discharged sheets of paper p and frame 202 (see FIG. 6) to support bins 200. Bins 200 are supported by frame 202 with fixed intervals in a vertical direction and with inclination. Frame 202 supports the inclined lower ends of bins 200.

Figure 2:
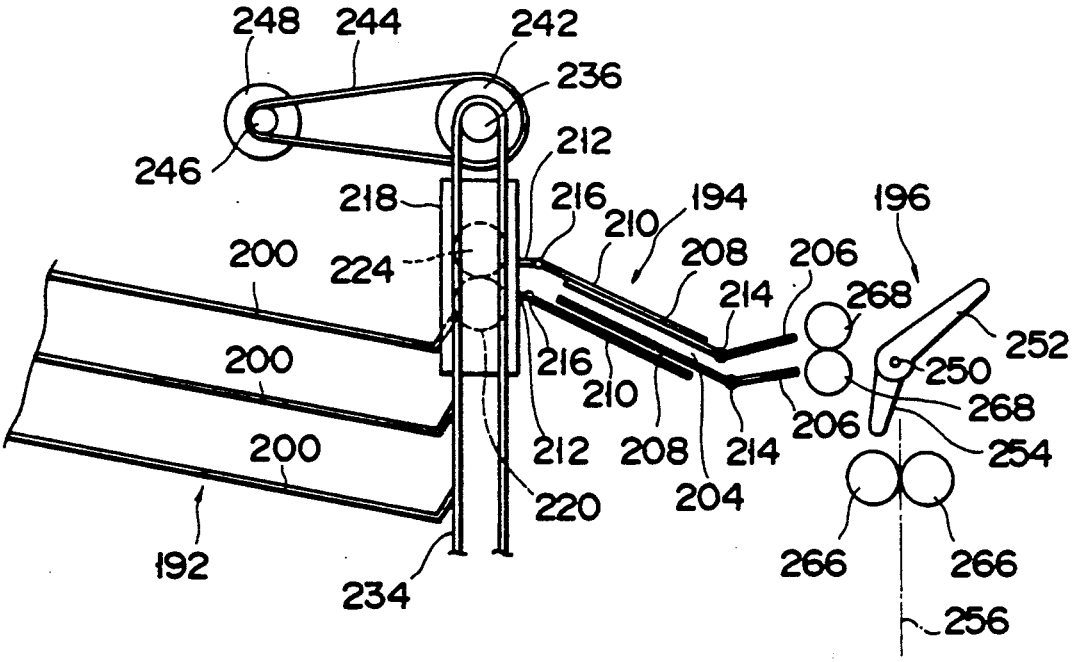
FIG. 2 is a front elevation of the drive mechanism of an original guide unit of a sorter device used in the electronic copying machine shown in FIG. 1.
Figure 3:
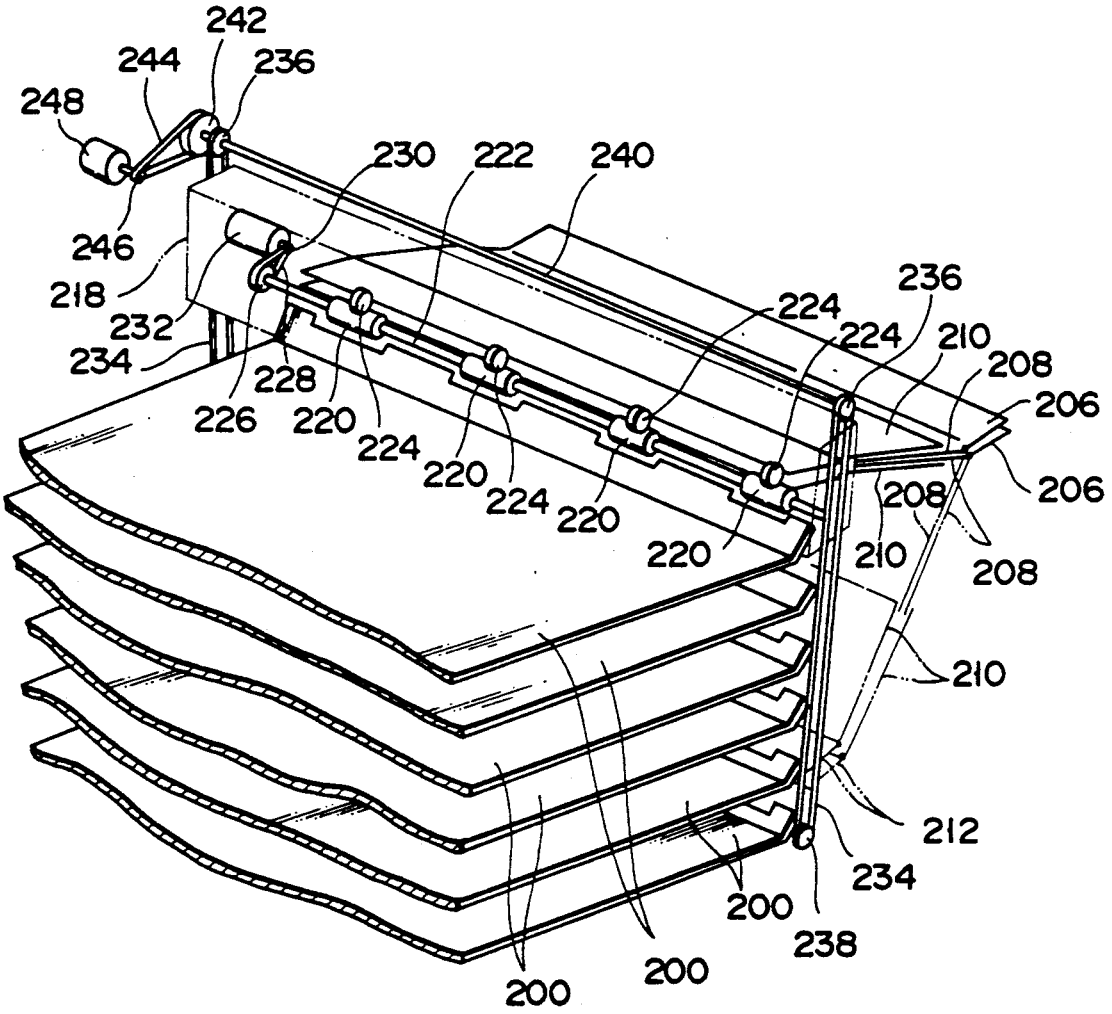
FIG. 3 is a perspective view of the drive mechanism shown in FIG. 2.

Guide unit 194 comprises, as shown in FIGS. 2 and 3, first to fourth guide plates 206, 208, 210 and 212 which, respectively, form vertical pairs to define sheet guide passage 204. One end of first guide plates 206 faces discharge roller 148 with sheet reversing unit 196 therebetween. Second guide plates 208 are rotatably connected at one end to the other ends of first guide plates 206 via pins 214. Third guide plates 210 slidably receive therebetween the other ends of second guide plates 208. The other ends of third guide plates 210 are rotatably connected via pins 216 to one end of each of fourth guide plates 212. The other ends of fourth guide plates 212 are connected to elevation frame 218, which comprises shaft 222 for supporting a plurality of drive rollers 220 and a shaft, not shown, for supporting a plurality of follower rollers 224. Shaft 222 is driven by motor 232 via pulley 226, belt 228 and pulley 230. Motor 232 is secured to elevation frame 218 with its ends connected to a pair of belts 234. Belt 234 is passed around over pulleys 236 disposed vertically with a spacing therebetween. Upper pulley 236 is connected to shaft 240 driven by elevator motor (pulse motor) 248 via reduction means comprising pulley 242, belt 244 and pulley 246.

Actuation of motor 248 permits elevation frame 218 to move upward and downward, whereby second and third guide plates 208, 210 pivotally connected to pins 214 afford rotational upward and downward movements. Pins 214 are located at a level between the uppermost and lowermost positions of elevation frame 218. Simultaneously, second guide plates 208 slide on third guide plates 210, so that the length of sheet guiding passage 208 between pins 214 and pins 216 is increased or decreased. Elevation frame 218 can take the uppermost position as is indicated by the solid lines in FIG. 4. When frame 218 is located between this uppermost position and the lowermost position, second guide plates 208 are inserted most deep into third guide plates 210, so that sheet guide passage 204 connecting discharge rollers 148 to sorting rollers 220 becomes the shortest. Whereas, when elevation frame 218 is at the lowest position, second guide plates 208 are, as shown in imaginary lines in the same figure, most shallowly inserted into guide plates 210, thus rendering maximum the length of guide passage 204 between discharge rollers 148 and sorting rollers 220.

Figure 4:
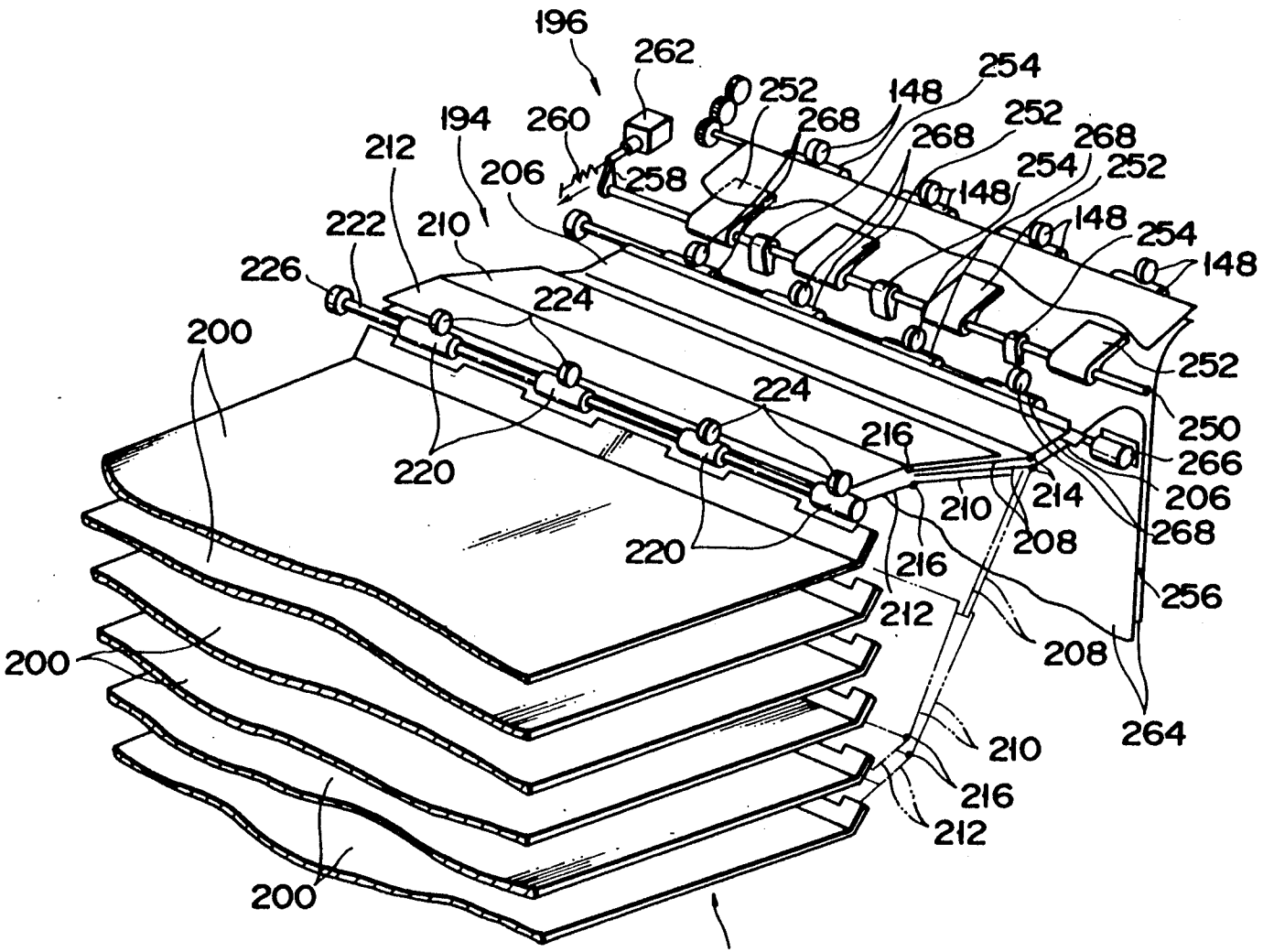
FIG. 4 is a front elevation of a sheet reversing mechanism employed in the sorter device used in the electronic copying machine shown in FIG. 1.
Figure 5:
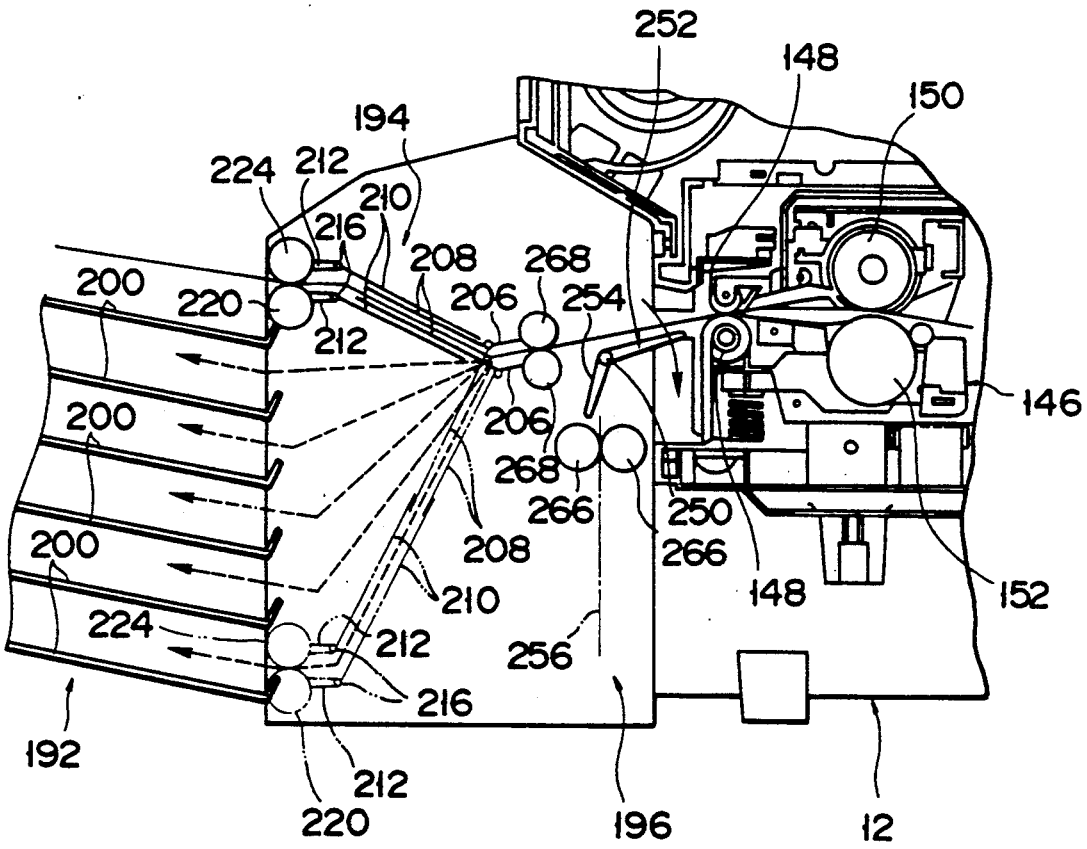
FIG. 5 is a cross section of the sheet reversing mechanism shown in FIG. 4.

As shown in FIGS. 4 and 5, reversing unit 196 is disposed intermediately of discharge rollers 148 and guide unit 194 and has rotatable shaft 250 on which a plurality of first gates 252 and second gates 254 are alternately mounted with fixed spacings.

First gates 252 are used to distribute sheets p from discharge rollers 148 selectively to guide unit 194 and reverse delivery passage 256. First gates 252 are so mounted that they rotate with shaft 250.

To one end of shaft 250 is connected lever 258, which is rotatedly urged by a spring 260 in the direction indicated by the arrow in FIG. 4. To lever 258 is connected a solenoid 262 to be controlled by control means not shown. In more particular, when the original D is supplied from feeding plate 164 in the first copying cycle, solenoid 262 is energized to cause first gates 252 to be shifted to a position at which sheet p from discharge rollers 148 is guided to guide unit 194. After this first copying cycle, a second sheet p from discharge tray 180 is placed on feeding plate 164 to initiate a second copying cycle. In this second cycle, solenoid 262 is deenergized thereby shifting first gates 252 to a position to guide the sheet p from discharge rollers 148 to sheet reversing passage 256.

Disposed below first and second gates 252, 254 are a pair of guide plates 264 and a plurality of pairs of forward and reverse rotatable reversing rollers 266, which together with guide plates 264 form sheet reversing passage 256. A plurality of pairs of delivery rollers 268 are disposed intermediately of first and second gates 252, 254 and first guide plates 206 to deliver to guide unit 194 the sheet p sent from discharge rollers 148 via first gates 252 and the sheet p sent past reversing passage 256 via second gates 254.

Second gates 254 which are rotatably mounted on shaft 250 are used to deliver the sheet p from reversing passage extending downwardly of shaft 250 to guide unit 194, whereby second gates 254 are normally situated in a position capable of transporting the sheet p from reversing passage 256 to guide unit 194 by the action of its own weight. When the sheet p from discharge rollers 148 is guided to sheet reversing passage 256 by first gates 252, second gates 254 are pushed by the sheet p and rotated to a fixed position to guide the sheet p to reversing passage 256.

As shown in FIG. 6, sideward movement unit 198 comprises guide rail 270 which supports frame 202 of bin unit 192 to enable it to move sidewardly in a direction perpendicular to the direction of discharge of the sheet p. Frame 202 is connected to an eccentric cam 274 via a link 272. Eccentric cam 274 is driven by motor 282 via pulley 276, belt 278 and pulley 280. Upon a half rotation of eccentric cam 274, bin unit 192 is moved by a predetermined distance δ. When eccentric cam 274 completes another half rotation, bin unit 192 is moved in an opposite direction by a distance δ. Motor 282 is electrically connected to automatic original feeder 14. When the supply of copy sheets p on original feeding plate 164 is sent out by automatic original feeder 14, an instruction to move is given to sideward movement unit 198 to drive motor 282.

Next, operation by sorter 16 of sorting image-fixed sheets p discharged from discharge rollers 148 will be explained.

When feeding is initiated in respect of a first supply of originals D, an image is first formed on the first sheet p. This sheet p is then introduced into sorter 16 by means of discharge roller 148 from copying device 12 with its image carrying surface facing upward. During this period, solenoid 262 is deenergized, so that first gates 252 are positioned as shown in FIG. 5 or 8C, permitting the sheet p to be delivered to delivery rollers 268 without its surface reversed but with its imaged surface facing upward. The sheet p is sent by delivery rollers 268 into guide plates 206 of guide unit 194. At this time, elevation frame 218 faces bins 200 located at the highest level. The sheet p travels to rollers 218, 220 via first to fourth guide plates 206, 208, 210 and 212. Rollers 220 permit the sheet p having its imaged surface facing upward to be discharged onto the highest positioned bin 200. After exhaust of the first sheet p, motor 248 is driven to permit elevation frame 218 to be lowered to face bin 200 positioned at the next highest level, whereupon second to fourth guide plates 208, 210, 212 are shifted. The second sheet p delivered from copying device 12 to sorter device 16 by discharge rollers 148 is likewise treated and discharged onto the second highest bin 200 with its image surface facing upward. Subsequent sheets are received by bins 200 at a gradually lowered level according to the number of copies desired and thus are sorted.

When a desired number of copy sheets p in a number not exceeding the number of bins 200 is received in respective bins 200, motor 248 is reversely rotated thereby elevating elevation frame 218 to the highest position. A second original D taken out from the first supply of originals is then automatically supplied to the copying process and after being imaged, fed out by discharge rollers 148 and placed on the sheets already received in the respective bins 200.

Similarly, originals D sheets placed in the third, fourth and further positions are automatically fed and copied, and finally accumulated on sheets p already received by bins 200.

When originals D are all fed from original feeding plate 164, they are taken out from original discharge plate 180 and again placed on feeding plate 164 for copying. Eccentric cam 274 of sideward movement unit 198 is driven by motor 282, whereby bin unit 192 is moved along guide rail 270 by a predetermined distance δ in a direction perpendicular to the direction of discharge of sheets p.

Figure 7A:
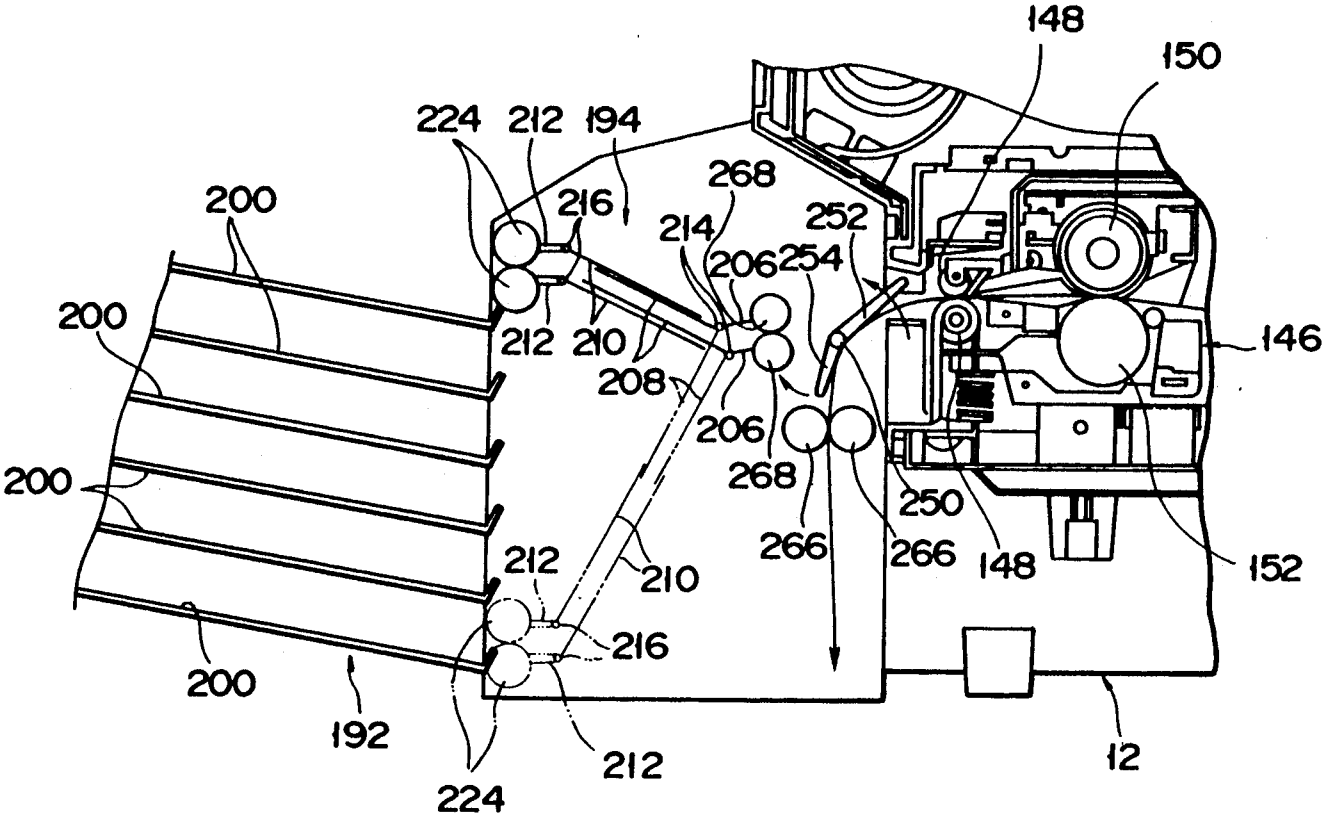
FIGS. 7A to 7C are front elevational views of the sheet reversing mechanism shown in FIG. 4 to amplify its operation.
Figure 7B:
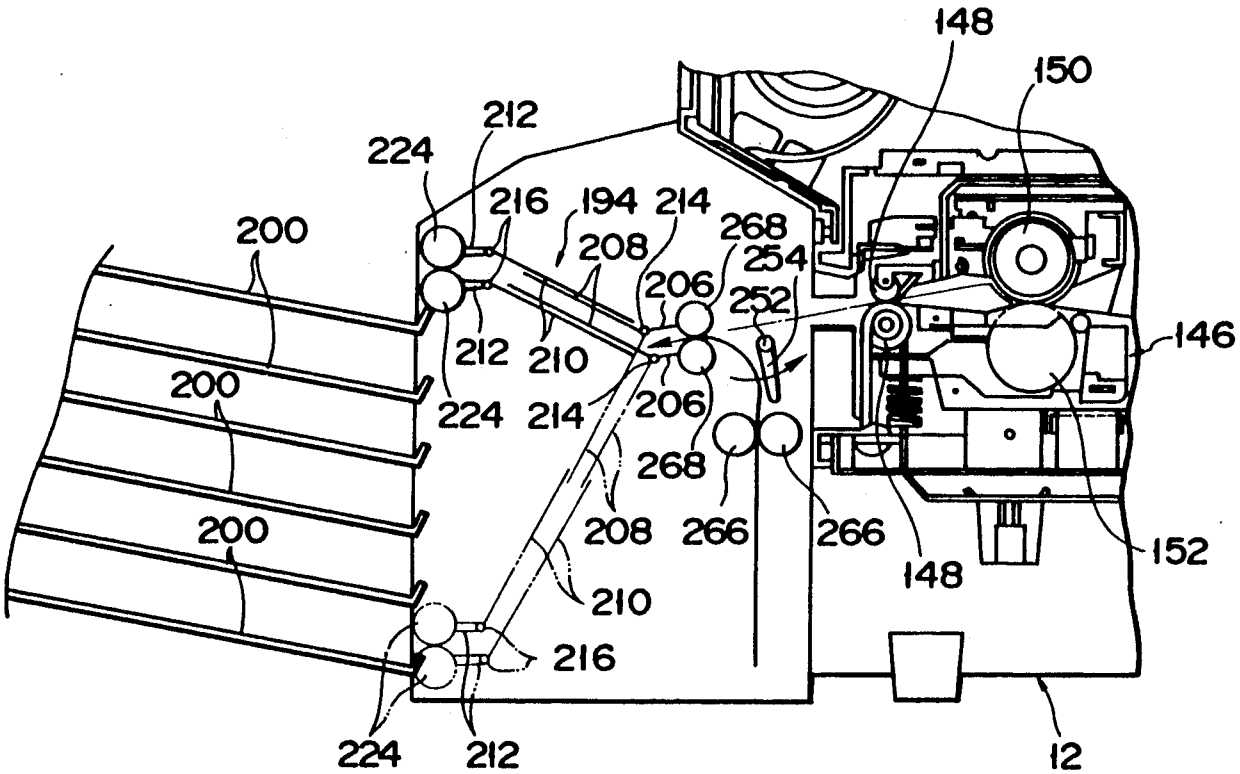
Figure 7C:
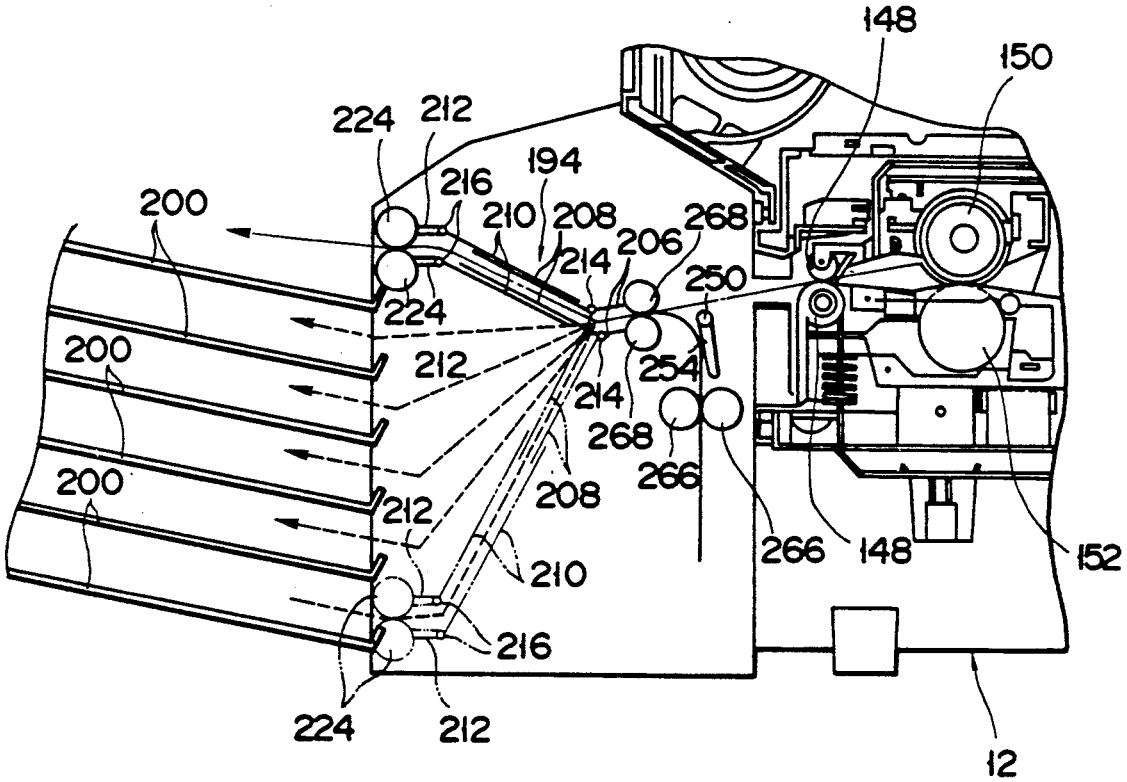
Figure 8B:
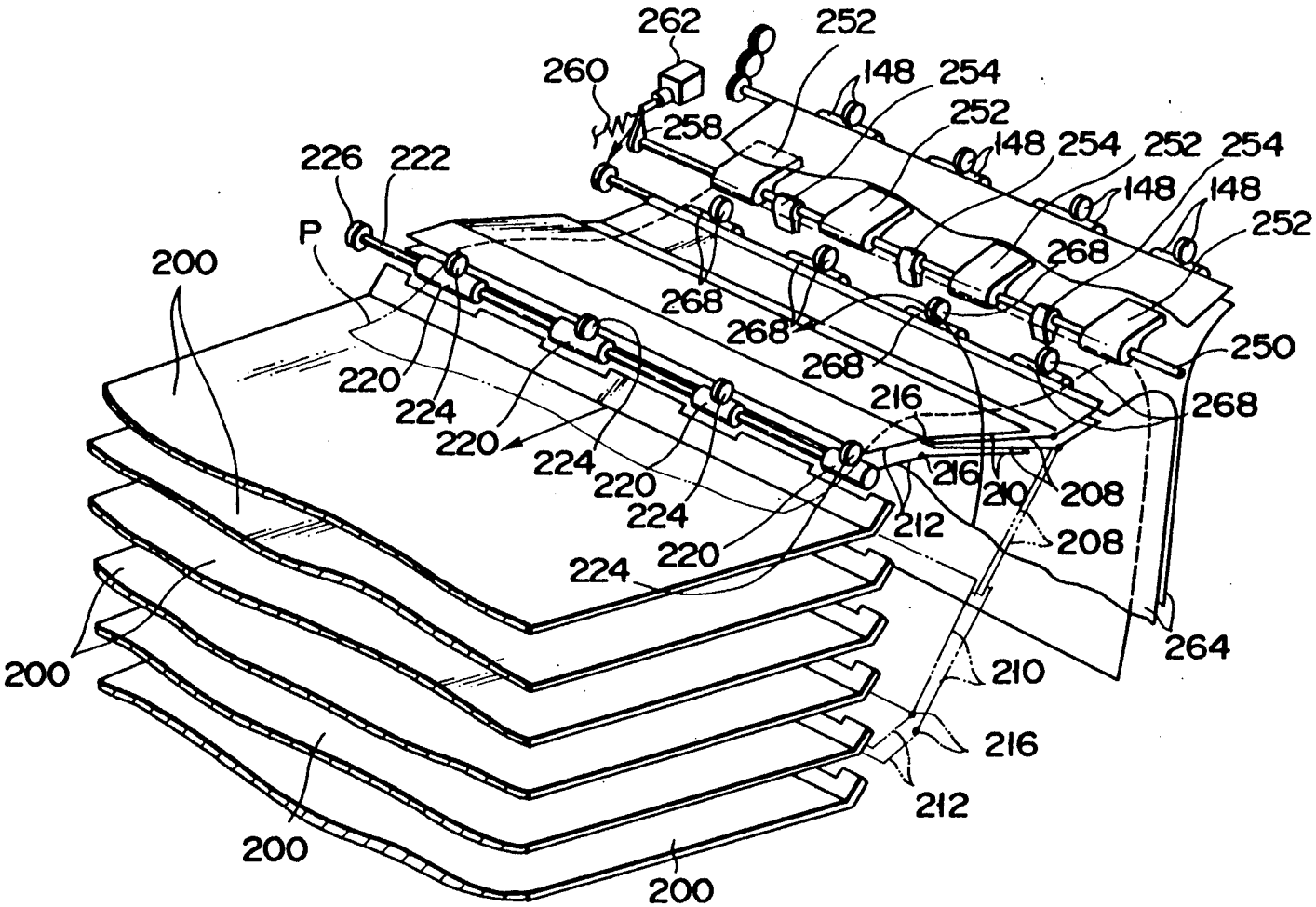
Figure 8C:
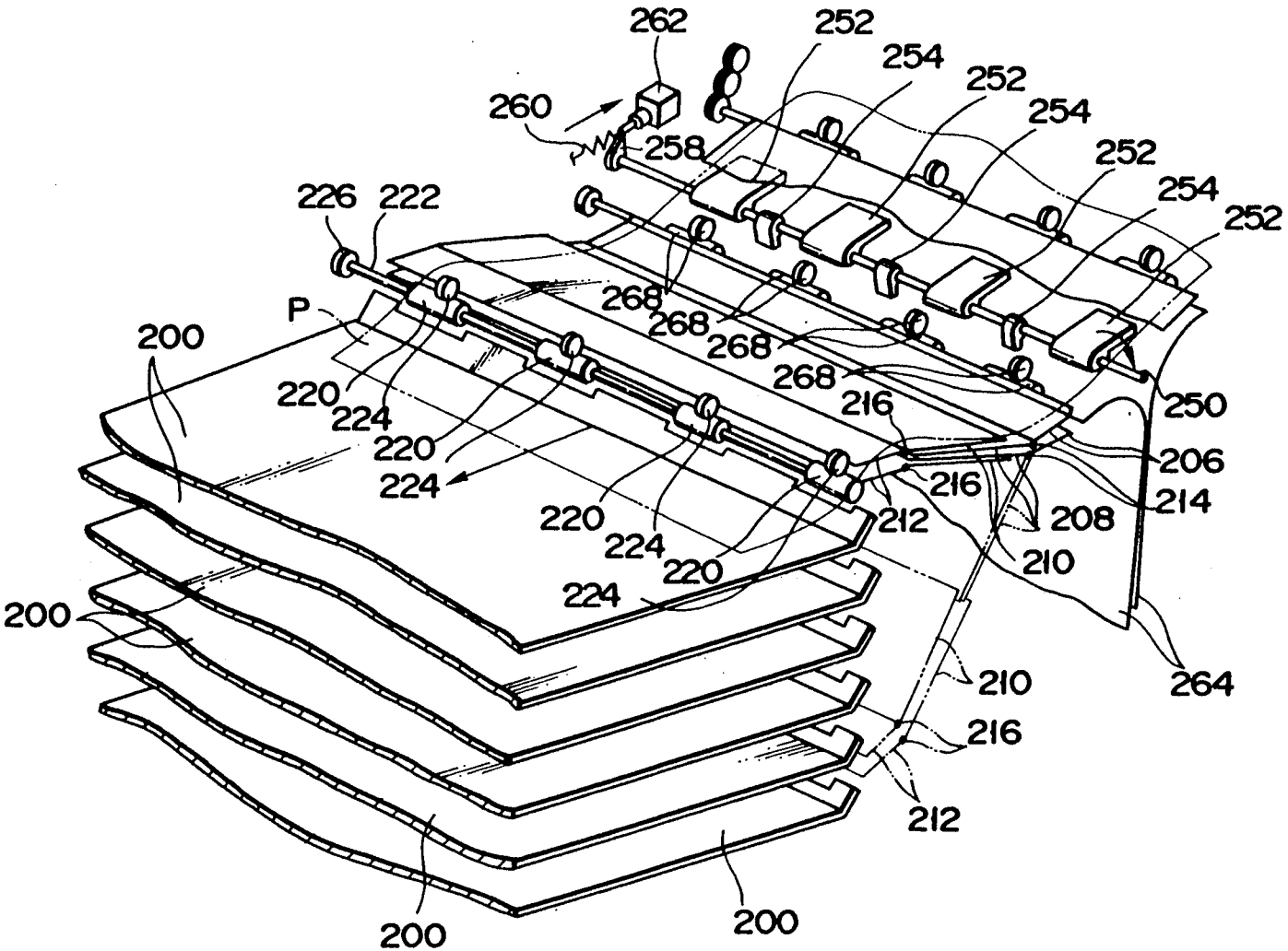
Figure 9:
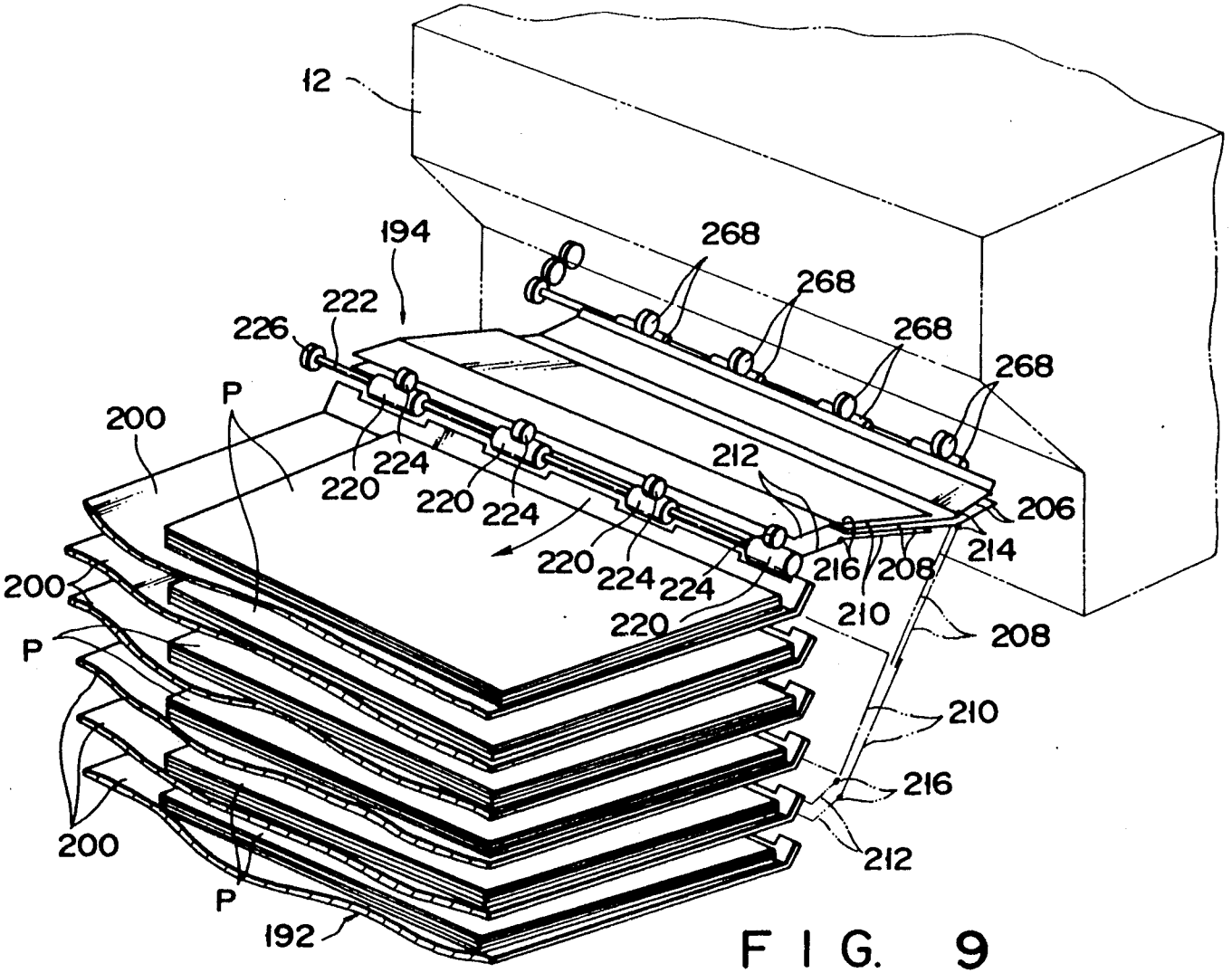
FIG. 9 is a perspective view showing the status of sheet material as sorted by the sorter device used in the electronic copying machine shown in FIG. 1.
Figure 10:
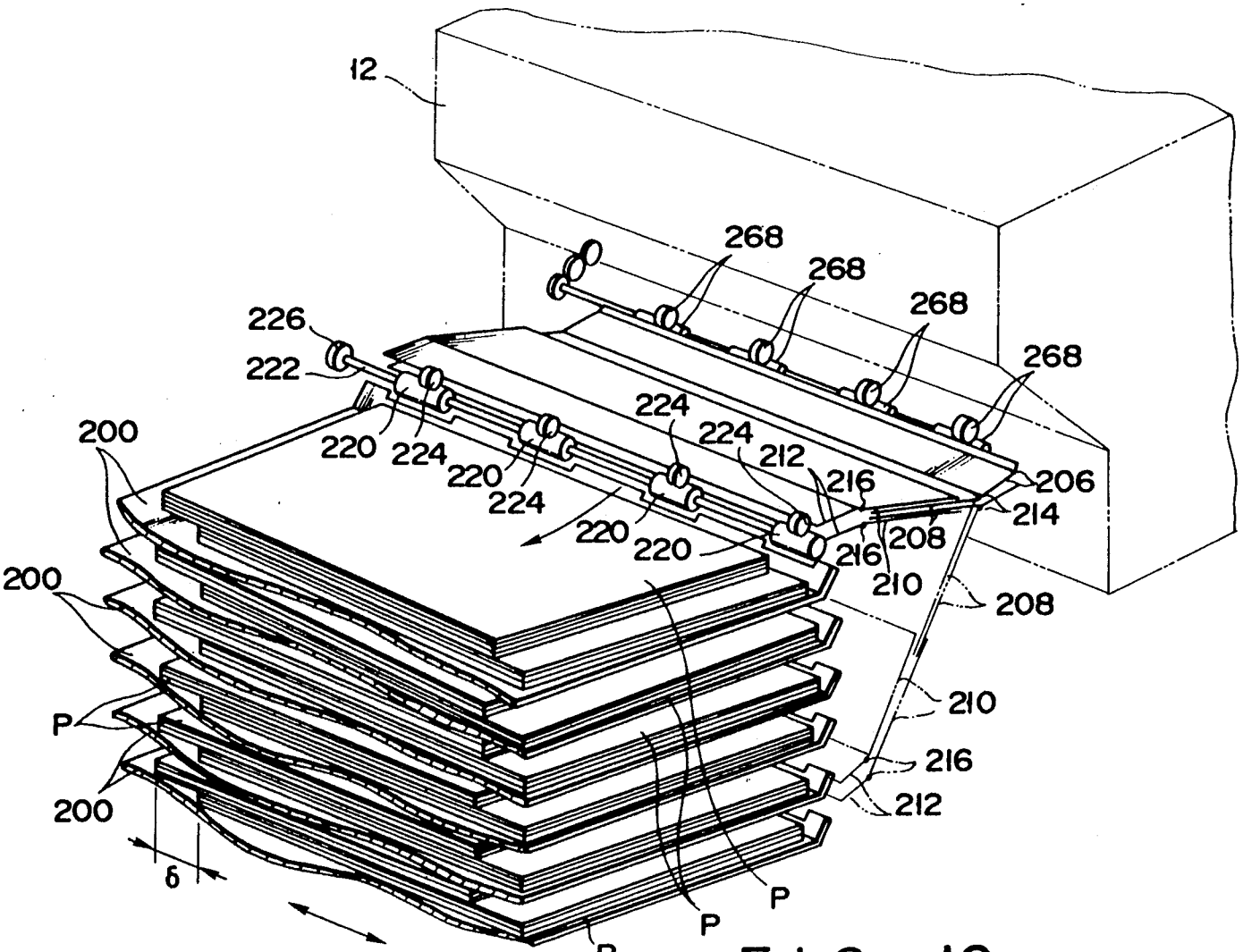
FIG. 10 is a perspective view showing the status of sheet material as moved sideward by the sideward movement unit shown in FIG. 8.

When a sheet p with its upper surface imaged is discharged by discharge rollers 148, solenoid 262 is in a deenergized state, so that first gates 252 are in a rotationally shifted position as shown in FIGS. 7A and 8A. Sheet p is guided to reversing passage 256 by first gates 252 as indicated by the arrow. In this instance, second gates 254 are pushed by sheet p for rotation. Sheet p then travels downwardly by the forward rotation of reversing rollers 266. When a predetermined amount of sheets p are delivered, sheets p are detected by a sensor not shown. The results of detection by the sensor cause reversing roller 266 to rotate in an opposite direction, and second gates 254 are then in a rotatedly shifted position as shown in FIGS. 7B and 8B. Sheet p sent by reverse rotation of reversing roller 266 is delivered to delivery rollers 268 by second gates 254. This process achieves reversing of the surface of sheet p. While retaining imaged surfaces facing downward, sheets p are delivered by delivery rollers 268 via first to fourth guide plates 206, 208, 210, 212 and placed on sheets p already received, viz. sheets p having an image of original D from the first supply of originals D, with shifting of a predetermined distance δ.

Because of the above mentioned arrangements, the sorting process may be achieved without vertical movements of all bins 200 and sheets p stored thereon but with movement of guide unit 194, so that less driving power of the machine is necessary in comparison with the machine wherein all bins and sheets carried thereon are subject to vertical movements for sorting.

Original D is placed on original feeding plate 164 with its image surface facing downward, in accumulation. Originals D are taken out from the top of the supply. After exposure, they are received in piles by original discharge plate 180 in the order they have been copied. In treating a first supply of originals D, finished copy sheets p bearing an image on the upper surface are received by bins 200 without its imaged surface reversed (upside down). In treating a second supply of originals D, sheet p with an image bearing upper surface are received by bin 200 after the imaged surface having been reversed. Therefore, the pages of originals D and those of copy sheets p can be made identical automatically, without requiring any additional work of reordering pages.

In contrast to the feeding of the first supply originals, in feeding the second supply of originals, bins 200 are shifted sidewardly by a fixed distance δ, and in addition, finished copy sheets p are received by bins 200 after reversing of the surface. Therefore, the number of sortings of sheets p may be increased without increasing the number of bins 200.

What is claimed is:

1. An image forming apparatus comprising:

take-out means for sequentially taking out a plurality of originals stacked in a given order, beginning with an uppermost original, and for returning the originals in an order opposite to said given order;

image-forming means for forming on sheets images corresponding to image information which is shown on the originals conveyed by the take-out means; and distributing means for distributing the sheets, said distributing means including a plurality of retaining means for retaining the sheets supplied from the image-forming means, and reversing means for reversing the stacking order of the sheets, said sheets being stacked in said retaining means in said given order when said sheets are taken out and conveyed in said given order, and being reversed and stacked in said retaining means when said sheets are conveyed in the order opposite to said given order.

2. The image forming apparatus according to claim 1, wherein said take-out means changes the order in which said sheets are stacked on said retaining means, each time said originals are taken out and supplied.

3. The image forming apparatus according to claim 1, wherein said distributing means includes:

a receiving section for receiving the sheets supplied from the image-forming means;

a discharging section, movable with reference to each retaining means, for discharging the sheets from the receiving section; and a guide section for guiding the sheets from the receiving section to the discharging section.

4. The image forming apparatus according to claim 3, wherein the guide section includes a guide member rotatable about the receiving section and which is extendable according to the position secured by the discharge section.

5. The image forming apparatus according to claim 4, wherein the guide member comprises a first guide member rotatably mounted on the receiving section at one end, and a second guide member which slidably engages the first guide member.

6. An image forming apparatus comprising:

take-out means for sequentially taking out originals of a plurality of groups including a first group and a second group, such that the originals are taken out one by one with respect to each group;

image-forming means for forming on a sheet an image corresponding to image information which is shown on the originals conveyed by the take-out means; and distributing means for distributing the originals, said distributing means including a plurality of retaining means for retaining the sheets supplied from the image-forming means, reversing means for reversing the sheets, and means for moving the retaining means between a first position and a second position, said sheets being stacked in the retaining means without being reversed when the originals of the first group are supplied, and being stacked in said retaining means after being reversed and with the retaining means moved to the second position when the originals of the second group are supplied, whereby the sheets corresponding to the originals of the second group are stacked while being shifted from each other in a desirable direction by a desirable distance.

7. The image forming apparatus according to claim 6, wherein said distributing means includes:

a receiving section for receiving the sheets supplied from the image-forming means;

a discharging section, movable with reference to each retaining means, for discharging the sheets from the receiving section; and a guide section for guiding the sheets from the receiving section to the discharging section.

8. The image forming apparatus according to claim 7, wherein the guide section includes a guide member rotatable about the receiving section and which is extendible according to the position secured by the discharge section.

9. The image forming apparatus according to claim 8, wherein the guide member comprises a first guide member rotatably mounted on the receiving section at one end, and a second guide member which slidably engages the first guide member.

10. An image forming apparatus comprising:

retaining means for retaining a plurality of originals which are stacked in a desirable order and contain image information;

take-out means for taking out the originals one by one, said take-out means having a stacking section where taken-out originals are stacked in an order opposite to said desirable order;

image forming means for forming on sheets an image corresponding to the image information of an original taken out by said take-out means;

a plurality of reception sections for receiving the sheets;

distributing means for distributing the sheet to the reception sections, said distributing means including direction-converting means for selectively converting directions of the sheets;

wherein said direction-converting means directs the image-formed sheet in a first direction when the image corresponding to the image formation of the original is formed by the image forming means in a first supply of originals, and directs the image-formed sheet in a second direction when the image corresponding to the image formation of the original is formed by the image forming means in a supply of originals taken from a stacking section for originals; and position converting means for positioning the reception sections in a first position when the image corresponding to the image information of the original is formed by the image forming means in the first supply of originals, and for positioning the reception sections in a second position when the image corresponding to the image information of the original is formed by the image forming means in the supply of originals taken from the stacking section for originals.

11. An image forming apparatus comprising:

information output means for outputting information of different kinds;

information forming means for forming an image corresponding to the image formation produced by the information output means on a plurality of sheets;

a plurality of retaining sections stationally disposed to retain sheets on which an image has been formed by the image forming means; and distribution means for distributing to the retaining sections, according to classification by image formation, a sheet bearing an image formed by the image forming means, the distribution means comprising a reception unit which receives the sheet bearing the image formed by the image forming means, a discharge section capable of being shifted to a position corresponding to that of the retaining sections, and a guide section which guides the sheet received by the reception section to the discharge section;

wherein the guide section includes a first guide member rotatably mounted on the reception unit at one end, and a second guide member which slidably engages the first guide member rotatably to the position secured by the discharge section.

12. A sorter comprising:

a receiving section for receiving sheets;

a plurality of fixed, vertically arranged retaining sections for retaining the sheets;

movable distributing means for distributing the sheets received at the receiving sections to the retaining sections, said distributing means including discharge means for discharging the sheets received at the receiving section to the retaining sections and guide means for guiding the sheets received at the receiving section to the discharge means;

the guide means including a guide member rotatable about the receiving section and expansible or contractible in accordance with the position of the guide member;

said guide member including a first guide member rotatably connected at one end to a receiving section and a second guide member rotatably connected at one end to a support means and slidably engageable with the first guide member;

said discharge means including a transfer roller for transferring the sheets, which have been guided by the guide means, to the retaining sections; support means for supporting the transfer roller; and conveyance means for vertically moving the support means such that the transfer roller faces one of the retaining sections.

* * * * *